United States Patent [19]

Feuling

[11] Patent Number: 4,796,426

[45] Date of Patent: Jan. 10, 1989

[54] HIGH EFFICIENCY TRANSITION ELEMENT POSITIONED INTERMEDIATE MULTI-CYLINDER EXHAUST SYSTEM AND SECONDARY PIPE ASSEMBLIES

[76] Inventor: James J. Feuling, 686 Ash Ave., Chula Vista, Calif. 92010

[21] Appl. No.: 631,218

[22] Filed: Jul. 16, 1984

Related U.S. Application Data

[63] Continuation of Ser. No. 394,910, Jul. 6, 1982, abandoned.

[51] Int. Cl.[4] ..... F02B 27/02; F01N 7/10

[52] U.S. Cl. ..... 60/313; 60/323

[58] Field of Search ..... 60/313, 312, 323

[56] References Cited

U.S. PATENT DOCUMENTS

| | | | |
|---|---|---|---|
| 2,841,951 | 7/1958 | Whitcomb | 60/313 |
| 3,453,824 | 7/1969 | Biesecker | 60/313 |
| 3,491,534 | 1/1970 | Garner | 60/313 |
| 3,516,247 | 6/1970 | Knox | 60/313 |
| 3,670,844 | 6/1972 | Penfold | 60/313 |
| 4,289,169 | 9/1981 | Banholzer | 60/323 |

FOREIGN PATENT DOCUMENTS

| | | | |
|---|---|---|---|
| 41723 | 3/1977 | Japan | 60/323 |
| 502124 | 4/1976 | U.S.S.R. | 60/323 |

*Primary Examiner*—Douglas Hart

*Attorney, Agent, or Firm*—Frank D. Gilliam

[57] ABSTRACT

An improved multi-cylinder engine exhaust header and single exhaust pipe transition element. The transition element comprises separate cylinder exhaust input connections, a gas chamber, a single exhaust gas output and a thin blade member positioned between at least two separate exhaust input connections. The forward end surface of the blade member takes various configurations to aid the mixing of the exhaust gases from each separate cylinder in the gas chamber prior to exit from the exhaust gas output.

17 Claims, 2 Drawing Sheets

HIGH EFFICIENCY TRANSITION ELEMENT POSITIONED INTERMEDIATE MULTI-CYLINDER EXHAUST SYSTEM AND SECONDARY PIPE ASSEMBLIES

BACKGROUND OF THE INVENTION

This is a continuation of application Ser. No. 394,910 filed 07/06/82, now abandoned.

This invention relates in general to the removal of exhaust gases from multi-cylinder engines and specifically to enhancing that exhaust gas flow externally of the engine.

A continuing effort is being extended to improve the efficiency of multi-cylinder internal combustion engines by the efficient and smooth removal of exhaust gases therefrom.

Conventional exhaust headers are especially well known in the field of automotive engines, particularly where either dual or single exhaust pipe transfer systems are utilized for the removal of exhaust gases from multi-cylinder engines. In conventional "V" type engines or other engine configurations where there are two separate exhaust port locations, a header and transition element are utilized for each exhaust port location and the exit end of the transition section either separately extend through a conventional tail pipe and muffler combination or are joined together exiting the engine through a single tail pipe/muffler combination.

Emergency vehicles such as fire engines and military equipment exit their exhaust gases directly into the atmosphere from the exit end of the transition element with the intent of improving the engine's efficiency. Strictly enforced noise pollution laws prohibit other vehicles from following this procedure for increasing engine efficiency.

State of the art conventional headers and transition elements restrict the flow of exhaust gases due to back pressure buildup, the so-called "reversionary" flow of exhaust gases back into the engine cylinder, sheer effect of multi-flows of exhaust gases into the transition element and restriction to rearward gas flow from the larger transition gas chamber to smaller or secondary tail pipe.

At the present time, much work is being done to provide exhaust systems for multi-cylinder internal combustion engines both in the automotive and stationary engine fields which will reduce fuel consumption of that engine while maintaining or improving its output power. There is, therefore, a need for new and improved transition elements for internal combustion engines and the like.

SUMMARY OF THE INVENTION

The above problems, and others, are overcome by an exhaust transition element of the instant invention which comprises an input end configured to accept, in a gas sealed relationship, a plurality of separate exhaust connections from a multi-cylindered engine and maintaining a separation of gases from an exhausting cylinder from a non-exhausting cylinder by means of a flat blade member interposed between at least two separate exhaust input connections, alternately one having exhaust gas flow therethrough and the other having no exhaust gas flow therethrough. The configuration of this transition element additionally prevents loss of exhaust energy due to transitional sectional area changes. When more than two separate input exhaust input connections are utilized, the flat blade member is positioned to separate those cylinders having alternately no exhaust gas flow from those cylinders having at least some exhaust gas flow. A gas collection chamber is divided into two sections by the flat blade member. The downstream end of the gas collection chamber is adapted to be connected to a conventional exhaust pipe/muffler combination either by fastener means or by a direct bond thereto as by brazing, welding, diffusion bonding or the like well known in the metal-to-metal attaching and bonding art.

In dynamometer and fluid flow tests it has been found that this novel transition element interposed between an engine exhaust header and conventional exhaust pipe/-muffler system produces improved engine performance. While the manner in which this system produces improved results over known transition element configurations is not fully understood, it is believed that the instant transition element and its interface to both the engine exhaust cylinders and conventional tail pipe/-muffler combination reduces gas flow resistence, back pressure and aids in the elimination of the so called "reversionary" effect common to conventional exhaust systems.

An object of the invention is to effectively eliminate interference to the free flow of exhaust gases from conventional multi-cylinder internal combustion engines fully in compliance with noise pollution restrictions.

Another object of this invention is to reduce so called "reversionary" positive pressure waves in multi-cylinder internal combustion exhaust systems.

These and other objects and advantages of the invention will become better understood by reference to the following detailed description when considered with the drawings, in which:

DETAILED DESCRIPTION OF THE INVENTION

Figures 1, 2, 4:
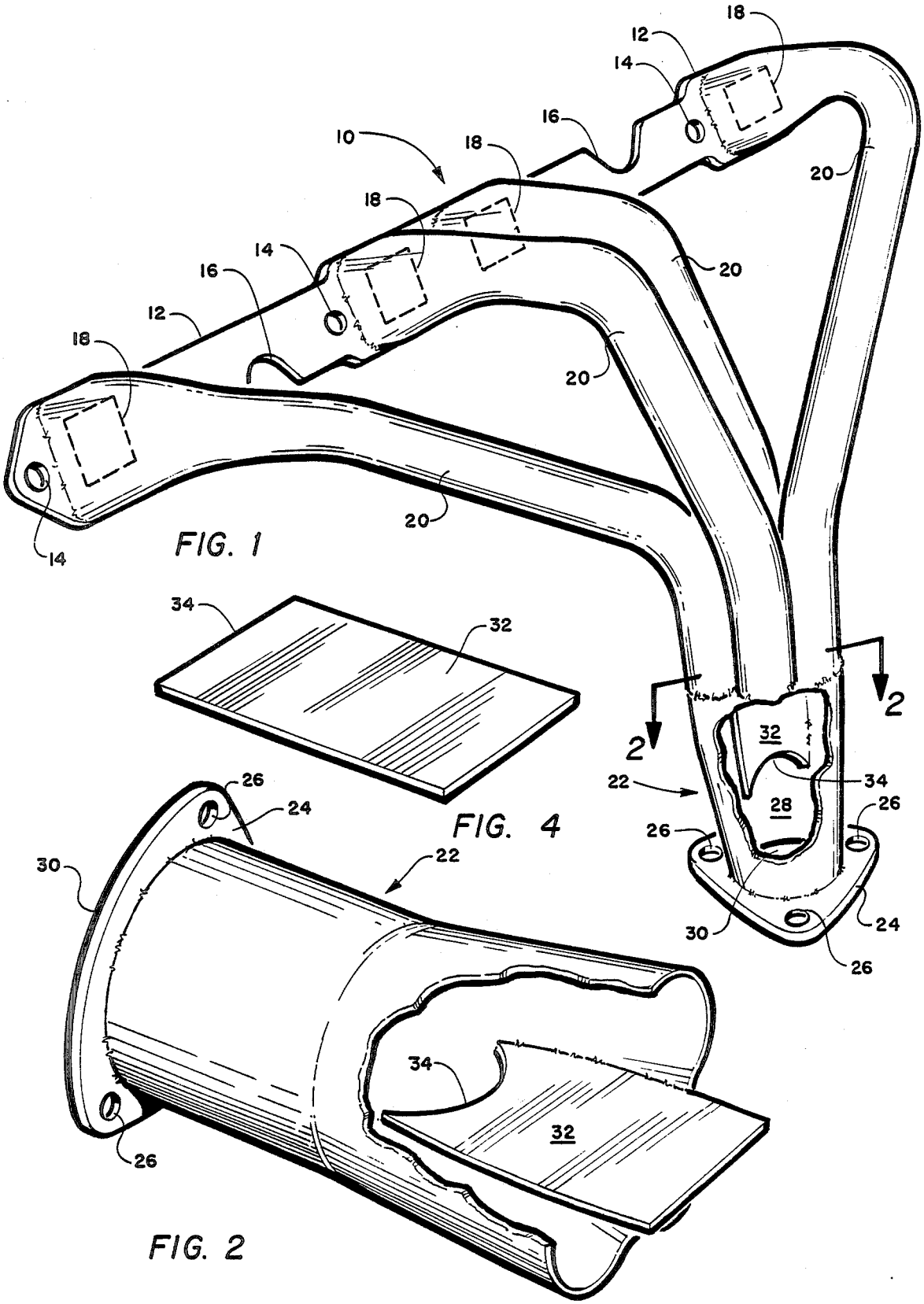
FIG. 1 is a perspective showing of a multi-cylinder engine exhaust header including the transition element of the invention.
FIG. 2 is a partial cutaway showing of FIG. 1 taken along line 2—2.
FIG. 4 is a rectangular configured flat plate member.

Referring now to FIG. 1, there is shown a header assembly 10 for a multi-cylinder internal combustion engine. The header 10 may be for a four-cylinder engine or for one exhaust bank of an eight-cylinder engine of the "V8" variety. The header assembly 10 may take other different configurations for differently designed multi-cylinder internal combustion engines. The header assembly 10 includes an engine attachment bar or bracket 12 configured to attach to the engine head or block (not shown) by means of apertures 14 and stud/-washer/nut combination or washer/cap screw combination or the like (not shown).

The bar or bracket 12 includes a number of apertures 18 (shown in phantom) equal in number to the engine exhaust ports (four shown). Exhaust tubes 20 are welded to or attached in a conventional manner to the bar of bracket 12. This attachment must be sufficiently strong to resist vibrations, heat, etc. generally found in and around internal combustion engines and maintain an exhaust gas tight seal therebetween.

Figure 5:
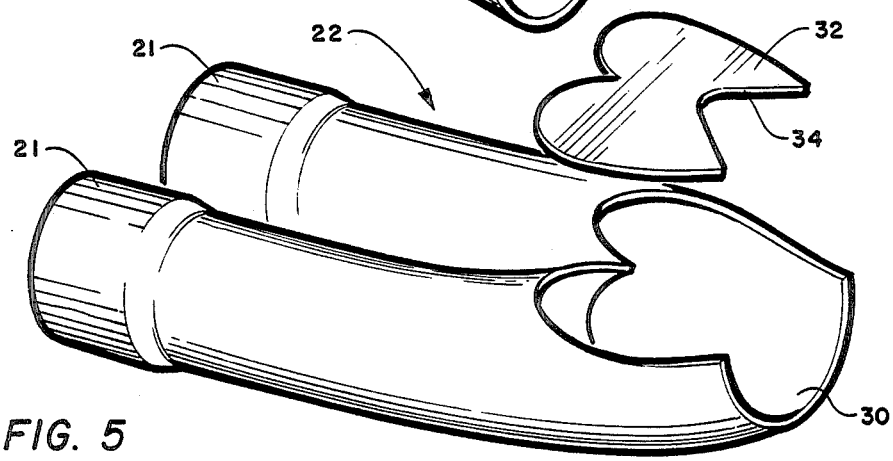
FIG. 5 is a cutaway portion showing a multi-cylinder input with a combined integral gas chamber and the flat plate divider element.

The exhaust tubes 20 may be attached to the transition element 22 in the same manner as their bar or bracket attachment end, may form a slip fit within an expanded tube end 21 as shown in FIG. 5 or form a slip fit into the convoluted or fluted receiving end of the transition element 22. The opposite end of the transition element may be provided with a connection flange 24 which has a plurality of apertures 26 for attachment to a conventional exhaust pipe/muffler combination or the like. It should be understood that rather than a flange 24, the transistor element may be attached by any bonding means or by a convenient method of attachment well known in the art. The principal connection requirement of the combined pipe/muffler combination is that a gas tight seal be maintained at all times under all conditions. It should be further understood that although only an exhaust pipe/muffler combination has been mentioned any other constituent component parts of a standard state of the art internal combustion engine exhaust system may be included, as for example, a catalytic converter or the like; however, a wide range of additional constituent components are intended to be included herein.

The transition element 22 including the multi-exhaust tube attachment end which, as aforementioned, can be seen in the various figures as having a convoluted or fluted configuration so as to conform and mate with the outer periphery of the connecting end of the transition element. Between the input and output ends of the transition element 22 there is a gas expansion chamber 28 in which the exhaust gases expand as they exit through output passage 30. Positioned within the transition element 22 is a flat blade member 32.

The flat blade member 32 is utilized to provide a separation between pairs of exhaust cylinders (FIG. 3) and four cylinder inputs (FIGS. 1, 2, 5 and 6). As can be seen in FIG. 1, pairs of exhaust tubes are divided by the flat plate member 32. It should be pointed out that the pairs are grouped in the firing order of the specific engine to which they are attached. In FIG. 1, port 18 on the far right in the figure is grouped with port 18 third from the far right, and cylinders two and four are grouped together. This grouping, as well as different groupings with engines with different firing orders, provides that simultaneous exhaust gas flows are directed to opposite sides of the blade member 32 within the expansion chamber 28. In our example, simultaneous flows and partial flows are positioned on opposite sides of the blade member 32. It is well known that due to various engine timing and cam angles, there is an overlap of exhaust gases leaving engine cylinders. It is intended that overlapping gas flows are directed to the opposite sides of the flat plate member 32.

The transition expansion chamber 28 is required to have cross-sectional area adjacent to the end 34 of flat plate member 32 equivalent to or slightly greater than the required combined cross-sectional area required for the combined overlapping gas flows. For example, if in a given side of the flat plate member 32, one cylinder is at maximum exhaust flow volume and on the opposite side of the flat plate member 32 a second cylinder is less than maximum exhaust flow volume, the expansion chamber 28 should not create any increased pressure to the maximum combined gas flow at its maximum volume. When the maximum combined gas flow is at a flow volume level less than its maximum combined flow volume level, the pressure of the gas flows will slightly decrease. Satisfactory flow conditions exist with gas flow speed changes in the range of from 75 to 120 percent of the gas flow speed of the maximum combined gas flows. An ideal range is from 95 to 105 percent with 100 percent being optimum.

Figure 3:
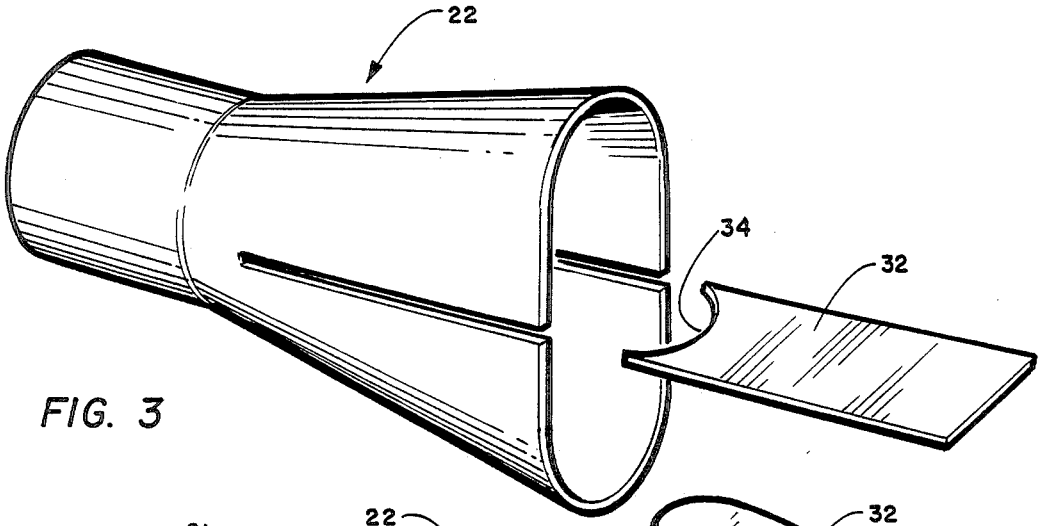
FIG. 3 is a showing of a transition element of the invention configured for exhaust gas inputs from two cylinders.

The shape of the flat plate member 32 affects the overall efficiency of gas flow from the delivery tubes 20 through the transition member 22. It has been found by actual test data that the flat plate member 32 shown in FIG. 4 having a rectilinear downstream end surface does in fact substantially increase the overall efficiency of the engine to which the system is attached, however, it has been found that a curvilinear or rectilinear bite from the downstream end surface significantly increases the engine efficiency over that of the downstream end configuration shown in FIG. 4. The semicircular bite shown in Figures 1, 2 and 3 provides substantially the same increase in engine efficiency as does the substantially rectilinear bite shown in FIGS. 5 and 6. The semicircular bite made by a circle having a diameter slightly larger, same as, or less than the width of the flat plate member at its cutaway end and the rectilinear bite with an area at least equal to the area removed by the semicircle appear to provide near maximum increased engine efficiency. It is not specifically known why the bite or its size are important to improved gas flow. It can only be speculated that the blade member 32 produces a more uniform gas flow through the transition element; the bite eliminates blade free end vibration preventing mechanical failure; the surface edges adjacent the bite are secured to the transition element increasing the mechanical bond between the flat plate member and the walls of the transition element and the increased surface area bonding between the edges and one end surface of the flat plate member and the transition element provide for an increased heat dissipation or heat removal from the surface of the flat plate member thus reducing the gas chamber termperature and increasing the useful bite of the flat blade member.

Figure 6:
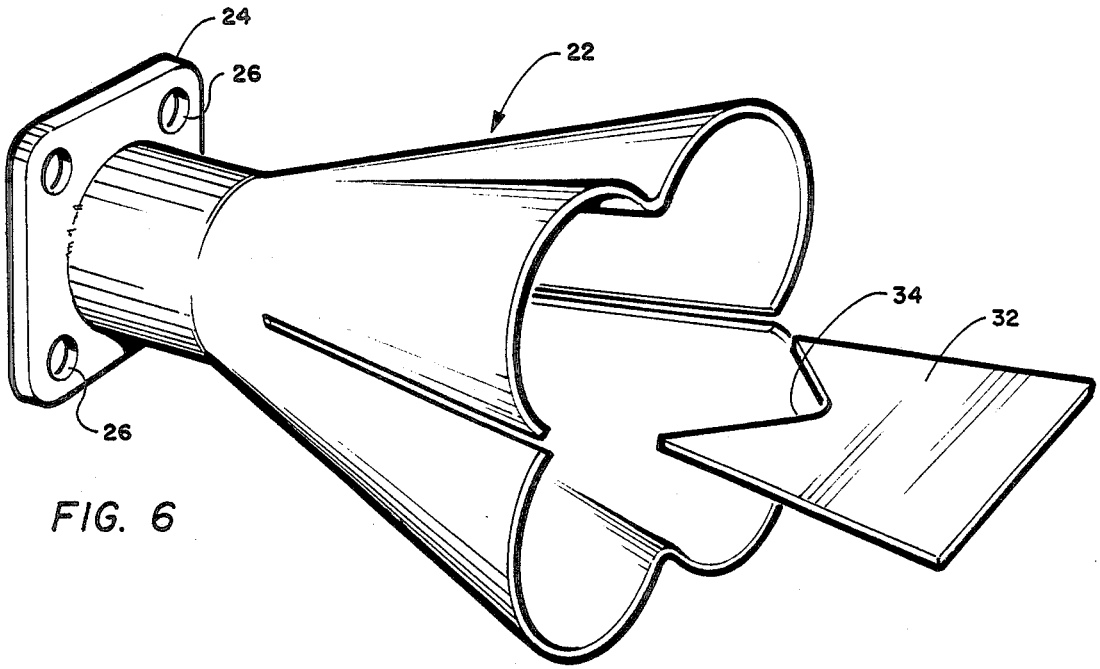
FIG. 6 is the showing of a transition element with multi-cylinder inputs, a divergent gas chamber and exhaust pipe attachment flange.

The FIGS. 2, 5 and 6 are suitable for four cylinders and FIG. 3 is designed for two cylinders. The various shapes of the flat plate members 32 other than the bite hereinbefore discussed in detail are chosen to configure with the required shape of the cross section of the exhaust tubes 20, to which it is attached.

While certain specific proportions and arrangements have been described in the above description, these may be varied, where suitable, within the limits described above.

The variations, ramifications and applications of the instant invention will occur to those skilled in the area upon reding the present disclosure. These are intended to be included within the scope of the invention, as defined in the appended claims.

Having thus described the invention, which is claimed as new and useful and desired to be secured by United States Letter Patent,

I claim:

1. An improved transition means for use with multi-cylinder engine exhaust systems comprising:

multi-cylinder exhaust gas input means, said multi-cylinder input means being adapted for accepting a plurality of separate tubular inputs, one input from each cylinder of at least one side of said engine;

a single exhaust gas output means;

an open chamber positioned intermediate said exhaust input means and said exhaust output means; and a thin flat blade member terminating at its downstream end within said open chamber and forming a gas tight seal between at least two of said plurality of separate tubular inputs at its upstream end, said thin flat blade member has an inwardly directed cutout across its downstream blade surface.

2. The invention as defined in claim 1 wherein said multi-cylinder exhaust input means is formed by a plurality of lobes equal in number to the number of input cylinders and said separate tubular inputs are secured to the distal end of said lobes in a gas tight relationship.

3. The invention as defined in claim 1 wherein said single exhaust means includes means for forming a gas tight connection to a conventional exhaust transfer system.

4. The invention as defined in claim 1 wherein the cross-sectional area of said open chamber is at least as great as the cross-sectional area of said output means.

5. The invention as defined in claim 1 wherein said cutout is curvilinear.

6. The invention as defined in claim 1 wherein said cutout is semi-circular.

7. The invention as defined in claim 1 wherein said cutout is angular.

8. The invention as defined in claim 1 wherein said cutout is is substantially triangular.

9. The invention as defined in claim 1 wherein each of said multi-cylinder exhaust input means forms at least a portion of said open chamber as an integral portion thereof.

10. The invention as defined in claim 1 wherein said cut out has an open area at least equal to an area of a semi-circle formed from a circle with a diameter substantially equal to the width of said thin blade member.

11. The invention as defined in claim 1 wherein the cross-sectional area of said single exhaust output means is substantially equal to the cross-sectional area of any one of said separate multi-cylinder input means.

12. The invention as defined in claim 1 wherein the cross-sectional area of said single exhaust output means is greater than the cross-sectional area of any one of said separate multi-cylinder input means.

13. The invention as defined in claim 1 wherein the cross-sectional area of the open chamber causes the speed of the exhaust gas entering the open chamber to be equal to or less than the speed of the exhaust gas exiting said single exhaust gas output means.

14. The invention as defined in claim 1 wherein said exhaust input means which have overlapping exhaust gas flow are terminated on the opposite sides of said thin blade member.

15. The invention as defined in claim 1 wherein the configuration of the open chamber causes the speed of the exhaust gas exiting said open chamber to be in the range of from 75% to 120% of the speed of the exhaust gas entering said open chamber.

16. The invention as defined in claim 1 wherein the configuration of the open chamber causes the speed of the exhaust gas exiting said open chamber to be in the range of from 95% to 105% of the speed of the exhaust gas entering said open chamber.

17. The invention as defined in claim 1 wherein the configuration of the open chamber causes the speed of the exhaust gas exiting said open chamber to be substantially equal to the maximum speed of the exhaust gas entering said open chamber.

* * * * *